United States Patent [19]

Hanyu et al.

[11] 4,313,389

[45] Feb. 2, 1982

[54] SEWING MACHINE WITH A PATTERN SELECTING DEVICE

[75] Inventors: Susumu Hanyu, Hachioji; Shyuzo Morimoto, Hino; Yasuro Sano, Hachioji, all of Japan

[73] Assignee: Janome Sewing Machine Co. Ltd., Tokyo, Japan

[21] Appl. No.: 129,208

[22] Filed: Mar. 10, 1980

[30] Foreign Application Priority Data

Mar. 26, 1979 [JP] Japan ..... 54-38904

[51] Int. Cl.[3] ..... D05B 3/02

[52] U.S. Cl. ..... 112/158 A

[58] Field of Search ..... 112/158 A, 158 D, 158 R

[56] References Cited

U.S. PATENT DOCUMENTS 4,184,440 1/1980 Matsumoto ..... 112/158 A 4,244,311 1/1981 Sano ..... 112/158 A

*Primary Examiner*—Peter P. Nerbun

*Attorney, Agent, or Firm*—Michael J. Striker

[57] ABSTRACT

A sewing machine comprises a housing, a needle bar adapted for reciprocating movement by a main shaft rotatably mounted in the housing and a fabric feeding device. A pattern control device is provided in the sewing machine which includes a number of needle bar control cams and fabric control cams operated by the main shaft. Two manually operated pattern selecting arrangements are mounted in the housing of the sewing machine including cams and cam followers and which are operatively connected to the fabric feeding device to control the movement thereof. In accordance with these pattern selecting arrangements the minimum rotation angle of the operating dial is made considerably large for selecting one of the pattern cams to thereby provide relatively small push angles for operating cam followers.

3 Claims, 3 Drawing Figures

SEWING MACHINE WITH A PATTERN SELECTING DEVICE

BACKGROUND OF THE INVENTION

The invention relates to a sewing machine, and more particularly relates to a pattern selecting device of a sewing machine, in which the operating dial may be rotated over a range of rotation angle of 360° so as to obtain much more varied stitch patterns from a limited number of pattern cams. Further in this invention, the minimum rotation angle of the operating dial is made considerably large to select one of the pattern cams, and, therefore, the associated pattern selecting cam may be made simplified to provide smaller push angles for operating cam followers. Thus, the machine operator may easily and smoothly operate the pattern selecting device without need of much operating force. Further in this invention, another simplified pattern selecting device has been suggested to additionally obtain further modified stitch patterns.

In the conventional zigzag sewing machines having many pattern cams to be selected by the operating dial of onerotation type, the minimum rotation angle of the operating dial for selecting a pattern cam is considerably small. Therefore, the pattern selecting cam operated in association with the operating dial is very complex, and requires relatively large push angles for operating the cam followers. As a result, the machine operator has to exert a considerable manual force to operate the operating dial at each time in order to select so many pattern cams. Further, according to the prior art, the number of varied stitch patterns is very limited.

SUMMARY OF THE INVENTION

The invention has been provided to eliminate the defects and disadvantages of the prior art. It is a primary object of the invention to provide a sewing machine which produces many varied stitch patterns by utilizing a limited number of pattern cams.

It is another object of the invention to provide a sewing machine which is simple in structure, and is easily and smoothly operated.

It is still another object of the invention to provide a sewing machine having two separate pattern selecting devices to additionally provide modified stitch patterns.

These and other objects are achieved by provision a sewing machine with a first pattern selecting means including a pattern selecting cam and a first follower connected therewith, a feed setting cam and a second follower associated therewith and a feed selecting cam operatively connected with a third follower operative to selectively engage or disengage the feed control cams associated with the fabric feeding device to control the movement thereof. A second pattern selecting means is provided in the sewing machine of the foregoing type, operatively connected to the third follower which engages or disengages one of the feed control cams.

By this provision the pattern selecting device of the sewing machine may be easily and smoothly operated by the machine operator without applying a considerably large operating force.

Many other features and advantages of the invention will be apparent from the following description of the preferred embodiment in reference to the attached drawings.

DETAILED DESCRIPTION OF THE INVENTION

Figure 1:
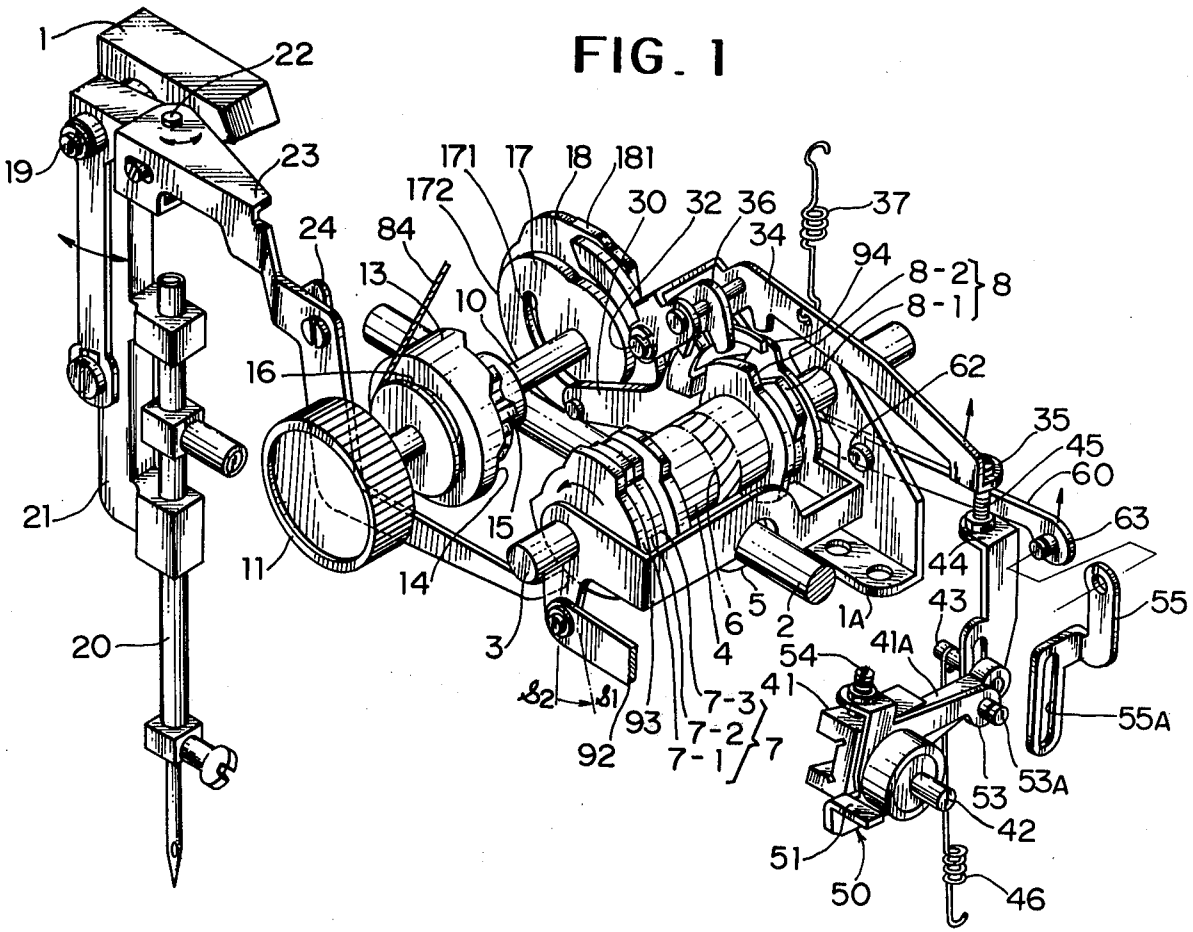
FIG. 1 is a perspective view of the mechanism of the invention.
Figure 2:
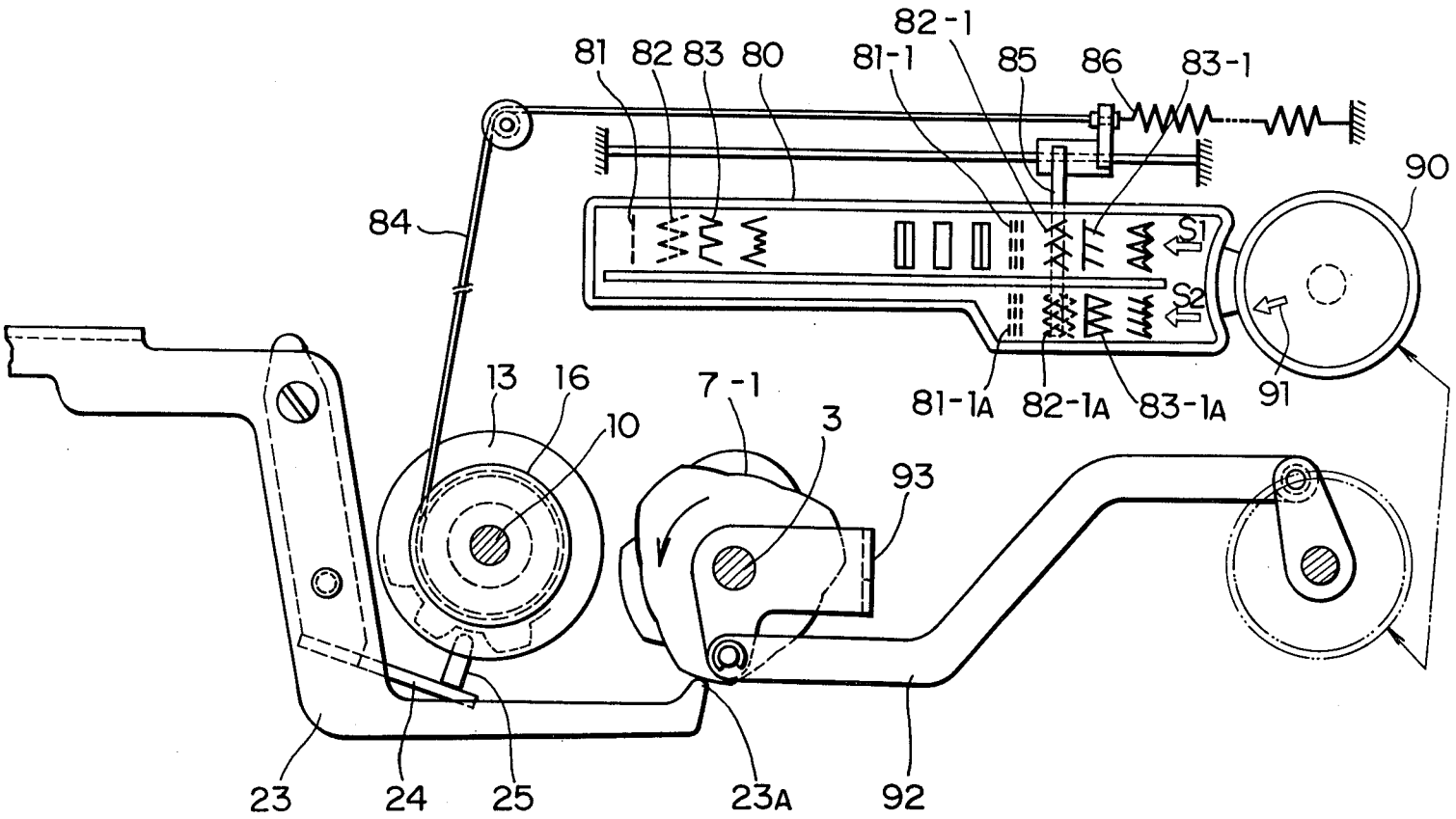
FIG. 2 is a front elevational view of the invention, with a portion removed.

In reference to FIGS. 1 and 2, the reference numeral 2 denotes a main shaft rotatably mounted on a machine housing 1A which is partly shown. A cam block 4 is rotatably mounted on a fixed transverse shaft 3. The cam block 4 is composed of a worm 6, needle control pattern cams 7 and fabric feed control cams 8. The worm 6 is in engagement with a gear 5 secured to the main shaft 2 to rotate the cam block 4 at a reduced speed. A transverse shaft 10 is rotatably supported on the machine housing 1A in parallel with the transverse shaft 3, and has an operating dial 11 secured to one end thereof which is protruded out of the machine housing on the front side thereof. Cams 13, 17, 18 are secured to the transverse shaft 10. The cam 13 is to select the pattern cams 7, the cam 17 is a feed control changeover cam and the cam 18 is to set the fabric feed in a constant condition with respect to a selected pattern. The cam 13 is formed with a side cam face and a cylindrical cam face 15 as shown.

A needle bar 20 with a needle is mounted on a needle bar support 21 for vertical reciprocating movement. The needle bar support 21 is turnably mounted to the machine housing 1 by means of a pivot 19. A transmission rod 23 is at one end thereof connected to the needle bar support 21 by means of a pivot 22, and has a follower **23*a* formed at the other end thereof for engaging with one of the pattern cams 7. A follower pin 25 is in engagement with the pattern selecting cam 13. The follower pin 25 is secured to the transmission rod 23 by means of a base plate 24 as shown in FIG. 2, and is normally pressed against the side cam face 14 of the pattern selecting cam 13 by means of a spring (though it is not shown), and is also pressed against the cylindrical cam face 15 of the pattern selecting cam 13 by means of a spring (not shown) which biases the needle bar support 21 in the rightward direction in FIG. 1**.

Figure 3:
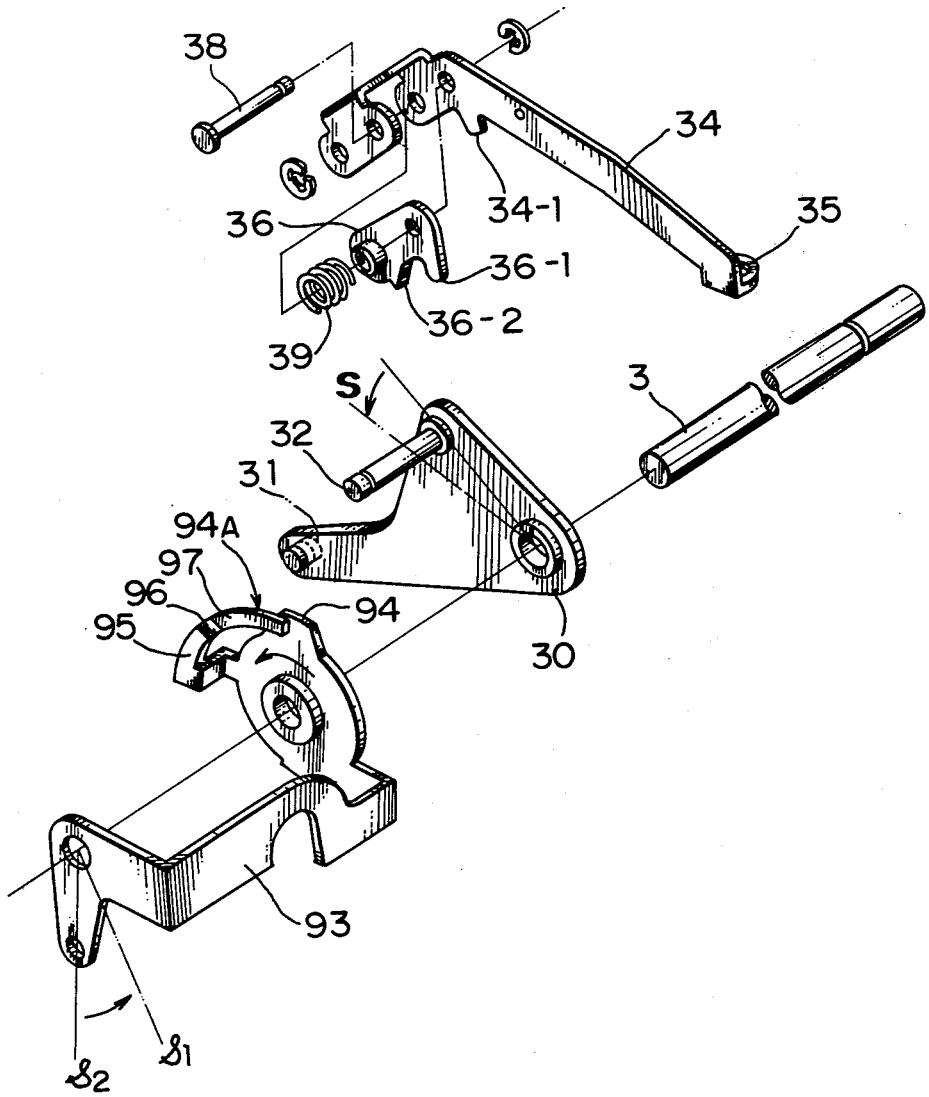
FIG. 3 is an exploded view of a part of the invention.

In reference to FIGS. 1 and 3, a changeover arm 30 is at the base thereof turnably mounted on the transverse shaft 3. The changeover arm 30 has a follower pin 31 provided at the free end thereof, which is in contact with the feed control changeover cam 17 at the underside thereof by means of a tension spring 37 which is operatively connected to the changeover arm 30. A transmission rod 34 is at one end thereof turnably mounted on a pivot 32 of the changeover arm 30, and is at the other end 35 thereof connected to the upper end of a vertical rod 44 by means of an adjustable screw 45. The transmission rod 34 is normally biased in the counterclockwise direction by means of the tension spring 37. A follower 36 is turnably mounted on a transverse pin 38 at one end part of the transmission rod 34 and is shiftable therealong, and thus engages with any of the feed control cams 8 when the changeover arm 30 is turned in the counterclockwise direction and the pivot 32 comes to a lower position. The follower 36 is biased in one direction by a spring 39 as shown in FIG. 3.

A U-shape operating member 93 is turnably mounted on the transverse shaft 3. The operating member 93 is at one end thereof formed with a cam 94 which is arranged opposite to a projection 34-1 of the transmission rod 34. Adjacent to the cam 94, the operating member 93 is formed with an arcuated extension 94A providing two offset faces 95, 97 which are connected by an inclined part 96. These offset faces 95, 97 are each engaged by one side of a projection 36-2 of the follower 36 which is slidable on the pivot 38 due to the action of the spring 39 in dependence upon the operated positions ($S_1$-$S_2$) of the operating member 93, so that the follower 36 with an engaging projection 36-1 may be displaced to the positions opposite to the feed control cams 8-1, 8-2 respectively.

As generally known, a feed adjuster 41 with an arm 41A is turnably mounted on a pin 42 which is arranged in parallel with the main shaft 2 of the sewing machine. The free end of the arm 41A is pivotally connected to the lower end of the vertical transmission rod 44 by means of a pin 43 which is biased in the clockwise direction by a tension spring 46 in such a manner that the feed adjuster 41 is inclined to produce a maximum fabric feeding amount in the forward direction, as shown in FIG. 1. A feed adjuster operating member 50 with an arm 53 is turnably mounted on the pivot pin 42 coaxially with the feed adjuster 41, and is biased in the same direction with the feed adjuster 41 by a comparatively weak spring (not shown). The feed adjuster operating member 50 is turned in the counterclockwise direction (in FIG. 1) until an engaging element 54 of the member 50 is pressed against the feed adjuster 41. As the operating member 50 is further turned in the same direction, the feed adjuster 41 is together turned in the same direction. As a result, in dependence upon the angular position of the feed adjuster 41, the fabric feeding amount is desirably determined in a condition reduced from the maximum feeding amount in the forward or backward feeding direction. On the other hand, if the operating member 50 is not activated at the free end of the arm 53, and is biased in the clockwise direction until a part 51 of the operating member 50 is stopped by a stopper (not shown) which may be provided at a desirable place of the machine housing 1, then the feed adjuster 41 can be freely turned irrespectively of the engaging element 54 of the operating member 50 by the vertical rod 44 against the action of the tension spring 46.

A vertical rod 55 is at the upper end thereof connected to one end of a transmission rod 60, which is at the intermediate part thereof turnably mounted on the machine housing by a pivot 62 and is at the other end thereof formed with a follower (not shown) which is in engagement with the feed control cam 8-1. The vertical rod 55 is formed with a vertical slot 55A at the lower end part thereof. The operating member 50 is connected to the vertical rod 55 by means of a pin 53A which is provided on the free end of the arm 53 and inserted into the vertical slot of the vertical rod 55.

The feed control changeover cam 17 is provided with a cam face 171 of a smaller diameter which maintains, substantially during the first one rotation thereof, the changeover arm 30 in an inoperative angular position, in which the pivot 32 supporting the transmission rod 34 and the follower 36 is in a raised position. The feed control changeover cam 17 is also provided with a cam face 172 of a larger diameter which maintains, in the second rotation thereof, the changeover arm 30 in an operative angular position in which the pivot 32 is in a lowered position.

On the other hand, the feed setting cam 18 is provided with a cam face 181 of a larger diameter which maintains, substantially during the first one rotation thereof, the feed adjuster 41 in a set position, in accordance with a selected pattern, through the transmission rod 60, the vertical rod 55 and the operating member 50. The feed setting cam 18 is also provided with a cam face of a smaller diameter (not shown) which maintains, in the second rotation thereof, the operating member 50 in a maximum angular position in the clockwise direction spaced from the feed adjuster (41).

A pattern indication panel 80 is provided on the front side of the sewing machine. Patterns 81, 82, 83 . . . are laterally arranged on the panel, as shown in FIG. 2, and are successively selected by turning the operating dial 11. A pattern pointer 85 is provided on a cord 84 which extends, as shown, from a drum 16 mounted on the transverse operating shaft 10 to one end of a tension spring 86 the other end of which is anchored to a part of the machine housing 1A, so that the pattern pointer 85 may be displaced along the laterally arranged patterns 81, 82, 83 . . . as the operating dial 11 is rotated. The panel 80 also indicates a group of patterns 81-1, 82-1, 83-1 . . . which are selected by turning the operating dial 11, and indexed by an arrow mark, and indicates another group of patterns 81-1A, 82-1A, 83-1A . . . indexed by an arrow mark $S_2$.

Adjacent to the pattern indicating panel 80, there is provided a pattern changeover operating dial 90 on the front side of the sewing machine. The operating dial 90 is operatively connected to the U-shape member 93 through a connecting rod 92, and is provided on the face thereof with an arrow mark 91. The arrow mark 91 points the indexing mark $S_1$ and $S_2$ as the operating dial 90 is turned between two predetermined angular positions thereof. At the same time, the U-shape member 93 is angularly displaced between the two predetermined positions indicated by $S_1$ and $S_2$ as shown in FIG. 3.

With the foregoing structure of the invention, if the operating dial 11 is rotated substantially in the range of first one rotation, the follower pin 31 of the changeover arm 30 remains in engagement with the cam face 171 of a smaller diameter of the feed control changeover cam 17. Therefore, the pivot 32 of the changeover arm 30 supporting the transmission rod 34 and the follower 36 is held in the raised angular position as shown by the solid line in FIG. 3. The follower 36 is, therefore, positioned spaced from the feed control cams 8, and the transmission rod 34 gives no influence to the feed adjuster 41. On the other hand, since the follower (not shown) of the transmission rod 60 remains in engagement with the cam face 181 of larger diameter of the feed setting cam 18 providing various cam lifts in accordance to the patterns to be stitched, the feed adjuster 41, which is turnable around the pivot 62, is set to effect a predetermined constant feeding amount in accordance with a selected pattern by one of the pattern cams 7 which is, as afore-mentioned, selected through the end follower 23A of the transmission rod 23 which is operated in association with the pattern selecting cam 13. By the way, the cylinder cam face 15 of the pattern selecting cam 13 is to disengage the follower 23A of the transmission rod 23 from one of the pattern cams 7 prior to the pattern cam selecting operation, and the side cam face 14 is to displace the follower 23A along the pattern cams 7.

If the operating dial 11 is further rotated and comes into a range of second rotation, the follower (not shown) of the transmission rod 60 comes to engage the cam face of smaller diameter of the feed setting cam 18. Therefore the tramsmission rod 60 gives no influence to the feed adjuster 41. On the other hand, the follower pin 31 of the changeover arm 30 comes to engage the cam face 172 of larger diameter of the feed changeover cam 17. The changeover arm 30 is therefore turned in the counterclockwise direction and displaces the pivot 32 to the lowered position as indicated by the broken line in FIG. 3. The follower 36 is, therefore, brought into engagement with one of the feed control cams 8-1, 8-2 for controlling the feed adjuster 41 through the transmission rod 34 and the vertical rod 44. Simultaneously, one of the pattern cams 7 is selected by the pattern selecting cam 13 and the transmission rod 23 with the end follower 23A which is operated in association with the pattern selecting cam 13. Thus a pattern is produced which is accompanied by a varied feed control as shown in the groups of patterns 81-1, 82-1, 83-1 . . . , and 81-1A, 82-1A, 83-1A . . . shown in FIG. 2.

When the operating dial 90 is turned to the position as shown in FIG. 2 in which the arrow mark 91 points the indexing mark $S_2$ on the pattern indication panel 80, the U-shape member 93 is held, through the connecting rod 92, in the angular position indicated by the solid line $S_2$ in FIG. 3. In this set position of the U-shape member 93, the follower 36 is at one face thereof pressed against the offset side 95 of the arcuated extension 94A of the member 93 by the compression spring 39. In this position, the follower engages the feed control cam 8-2 to produce, in cooperation with a specific one of the pattern cams 7, one of the patterns 81-1A, 82-1A, 83-1A . . . which are of a modified feed control. If the operating dial 90 is operated to set the arrow mark 91 to point the indexing mark $S_1$ on the pattern indication panel 80, the U-shape member 93 is turned from the angular position indicated by the solid line $S_2$ in FIG. 3 to the angular position indicated by the broken line $S_1$. In the meantime, the arcuated extension 94A is turned in the counterclockwise direction. As a result, the follower 36 is, due to the action of the compression spring 39, displaced on the inclined part 96 until one side of the follower 36 is pressed against the offset face 97 of the extension 94A while the cam 94 of the U-shape member 93 engages the downward projection 34-1 of the transmission rod 34 to disengage the follower 36 from the feed control cam 8-2. In this position, the follower 36 engages the feed control cam 8-1 to produce, in cooperation with the same one of the pattern cams 7 as to selection of the feed control cam 8-2, the corresponding one of the patterns 81-1, 82-1, 83-1, . . . which are of a further modified feed control.

We claim:

1. A sewing machine, comprising a machine housing; a main shaft rotatably mounted in said housing; a needle bar with a needle, said main shaft being operatively connected to said needle bar for vertical reciprocating movement thereof; a fabric feeding device operatively connected to said main shaft; a swingable support mounted in said housing for supporting said needle bar; pattern controlling means rotatable by said main shaft and including needle bar control cams for controlling the swingable movement of said needle bar and fabric feed control cams operatively connected to said fabric feeding device for controlling the movement thereof; first pattern selecting means including a pattern selecting cam and a first follower operatively connected therewith, said first follower being connected to said needle bar and operated by said pattern selecting cam to selectively engage said needle bar control cams, a feed setting cam and a second follower associated therewith, said second follower being operatively connected to said fabric feeding device and adapted to set said device for the feeding movement in response to a position of said second follower with respect to said feed setting cam, a feed selecting cam and a third follower operatively connected therewith, said third follower operated by said feed selecting cam to selectively engage with or disengage from said feed control cams for controlling the movement of said fabric feeding device; said pattern selecting cam, said feed setting cam, and said feed selecting cam being coaxially mounted on a manually rotated shaft, said feed setting cam displacing said second follower into an operative position during a first complete rotation of said said feed setting cam and displacing said second follower into an inoperative position during the next rotation of said feed setting cam, said feed selecting cam displacing said third follower into an inoperative position in which said third follower is disengaged from said feed control cams during a first complete rotation of said feed selecting cam and displacing said third follower into an operative position in which said third follower engages one of said feed control cams during the next rotation of said feed selecting cam; and second pattern selecting means operatively connected to said third follower, said second pattern selecting means being manually operated to selectively engage or disengage said third follower with one of said feed control cams.

2. The sewing machine of claim 1, further comprising means for connecting said fabric feeding device to said third follower, said means including an arm carrying a pin, said third follower being shiftably mounted on said pin.

3. The sewing machine of claim 2, wherein said second pattern selecting means include a cam, said cam being positioned on a shaft carrying said pattern controlling means.

* * * * *